United States Patent [19]

Bakermans et al.

[11] Patent Number: 4,884,484

[45] Date of Patent: Dec. 5, 1989

[54] STRIP RETAINER AND STRIPPER FOR STAMPING AND FORMING MACHINE

[75] Inventors: Johannes C. W. Bakermans, Harrisburg; Dimitry G. Grabbe, Middletown, both of Pa.

[73] Assignee: AMP Incorporated, Harrisburg, Pa.

[21] Appl. No.: 221,064

[22] Filed: Jul. 19, 1988

[51] Int. Cl.[4] ..... B21D 45/06

[52] U.S. Cl. ..... 83/145; 83/282; 83/374; 83/451; 83/679; 83/697; 72/405; 72/450

[58] Field of Search ..... 83/145, 282, 513, 374, 83/628, 602, 917, 110, 517, 671, 346, 679, 685, 697; 72/405, 450

[56] References Cited

U.S. PATENT DOCUMENTS 1,962,432 6/1934 Daley ..... 83/145

4,489,871 12/1984 Bakermans .

4,497,196 2/1985 Bakermans et al. .

*Primary Examiner*—Donald R. Schran

[57] ABSTRACT

Strip retainer and stripper which is used on a stamping and forming machine for stripping or removing the stock material from the pilot pins and punches when the punches and pilot pins move from their closed positions to their open positions, comprises one or more wires in the operating zone of the machine. Each wire extends transversely across, and intersects, the path of reciprocation of the punch assmebly. The wire does not intersect the path of reciprocation of the pilot pins or the punches and is located between the punches and pilot pins and the surface of the stock material. The ends of the wires extend beyond the path or reciprocation of the punch assembly and are secured by fixed securing devices.

8 Claims, 12 Drawing Sheets

STRIP RETAINER AND STRIPPER FOR STAMPING AND FORMING MACHINE

FIELD OF THE INVENTION

This invention relates to stripping and restraining devices of the type which are used on stamping and forming machines for restraining movement of the stock metal with the pilot pins or punches when the punches and pilot pins move away from the stock metal after holes have been punched in the material by the punches. The principles of invention can be used with many types of stamping and forming machines, however the invention is described below in conjunction with a machine of the type described in U.S. Pat. No. 4,497,196.

BACKGROUND OF THE INVENTION

In a conventional stamping and forming operation, strip material is fed through an operating zone between a punch assembly and a die assembly. The punch and die assemblies move relatively towards each other and the punch punches a hole in the strip and moves into a die opening in the die assembly. Thereafter, the punch assembly and die assembly move apart and the strip is again fed for the next operating cycle. It is also common practice to provide pilot pins on, or adjacent to, the punch assembly which enter previously provided pilot holes in the strip. The pilot pins precisely locate the strip in the operating zone of the machine so that the holes punched by the punches will be precisely located and/or any forming tools will engage the strip at a precisely predetermined position so that precisely dimensioned parts will be produced.

When the pilot pins and the punches move away from the strip after the punches have formed holes therein, there is often times a tendency for the strip material to move with the punches and/or the pilot pins laterally of the plane occupied by the strip in the center of the operating zone of the machine. Such movement of the strip results from the fact that the pilot holes will have a diameter only slightly greater than the diameter of the pilot pins and the holes produced by the punching operation will be only very slightly larger than the punches themselves. The friction developed between the punches and pilot pins and the strip therefore prevents the strip from remaining stationary when the punches and pilot pins are withdrawn and it tends to be dragged for a short distance with the punches and pilot pins when the punch assembly is moved from its closed position to its retracted or open position.

In order to overcome the problem discussed above, it is common practice in conventional stamping and forming machines to provide a stripping mechanism which restrains the movement of the strip when the punch assembly moves away from the strip to its open position. Where the machine has a conventional punch and die assembly comprising spaced apart die shoes which have the punches and dies mounted therein, it is common to provide a spring loaded rod or the like which bears against the strip and which is constructed such that when the die shoes move relatively towards each other, the spring which biases the rod is compressed. When the die shoes move relatively away from each other, the rod remains against the strip while the punches and pilot pins move away from the strip thus restraining the strip against movement and stripping the material from the pilot pins and the punches.

U.S. Pat. No. 4,497,196 discloses a stamping and forming machine in which the punches and dies are mounted on opposed spaced apart tooling assemblies which move relatively towards and away from each other during each operating cycle. For several reasons, conventional known types of stripping mechanisms are not practical for machines of the general type described in that patent. For example, both the die assembly and the punch assembly move during an operating cycle towards and away from each other between an open position and a closed position. The total stroke is thus the sum of the displacements of both of the tooling assemblies and the stroke of the punch assembly itself is therefore considerably smaller than the stroke of a conventional machine in which only the upper die shoe or the punch assembly moves. Additionally, machines of the type described in U.S. Pat. No. 4,497,196 are extremely compact and it is impractical to provide conventional stripping devices for the reason that there is simply not sufficient space to permit their inclusion.

The present invention is directed to the achievement of an improved stock retaining and stripping means which can be used to advantage on many types of stamping and forming machines and which is particularly adapted for use on machines of the general type described in U.S. Pat. No. 4,497,196 (which is hereby incorporated by reference in its entirety).

THE INVENTION

One embodiment of the invention is in the form of a machine for punching holes in strip material. The machine comprises strip feeding means for feeding strip material along a strip feed path which extends through an operating zone. A punch assembly and a die assembly are provided in the operating zone on opposite sides of the strip feed path. The punch and die assemblies are in opposed confronting relationship and are movable relatively towards and away from each other along a punch and die assembly path of reciprocation between an open position and a closed position. The punch and die assemblies are remote from each other in the open position and are proximate to each other in the closed positions. The punch assembly has punch means thereon and the die assembly has die opening means which is dimensioned to receive the punch means. The punch means is movable relatively towards and into the die opening means along a punch means path of reciprocation when the punch and die assemblies move from their open to their closed positions thereby to punch a hole in the strip material. The punch assembly also has pilot pin means extending therefrom and the strip material has pilot hole means which are dimensioned to receive the pilot pin means thereby precisely to position the strip material in the operating zone prior to the arrival of the punch assembly and the die assembly at their closed positions. The pilot pin means is reciprocable along a pilot pin path of reciprocation. The machine is characterized in that a strip retainer is provided for stripping the strip material from the pilot pin means when the punch assembly and the die assembly move from their closed positions to their open positions. The strip retainer comprises at least one static member which is beside, and adjacent to, the strip feed path and which is between the punch assembly and the strip feed path. The static member intersects the punch and die assembly path of reciprocation and is in non-intersecting relationship with the punch means path of reciprocation and in non-intersecting relationship with the pilot pin path of reciprocation. The strip retainer extends laterally beyond the punch and die path of reciprocation on two opposite sides thereof and has retainer ends which are secured to fixed securing means. During the operating cycle, the pilot pins means move into the pilot hole means in the strip material, and during subsequent movement of the punch assembly to its open position, the strip retainer restrains the strip material from being carried with the pilot pin means laterally of the strip feed path and thereby strips the strip material from the pilot pin means. The strip retainer preferably comprises a fine wire and may extend either parallel to the strip feed path or transversely of the strip feed path.

THE DRAWING FIGURES

Figure 4:
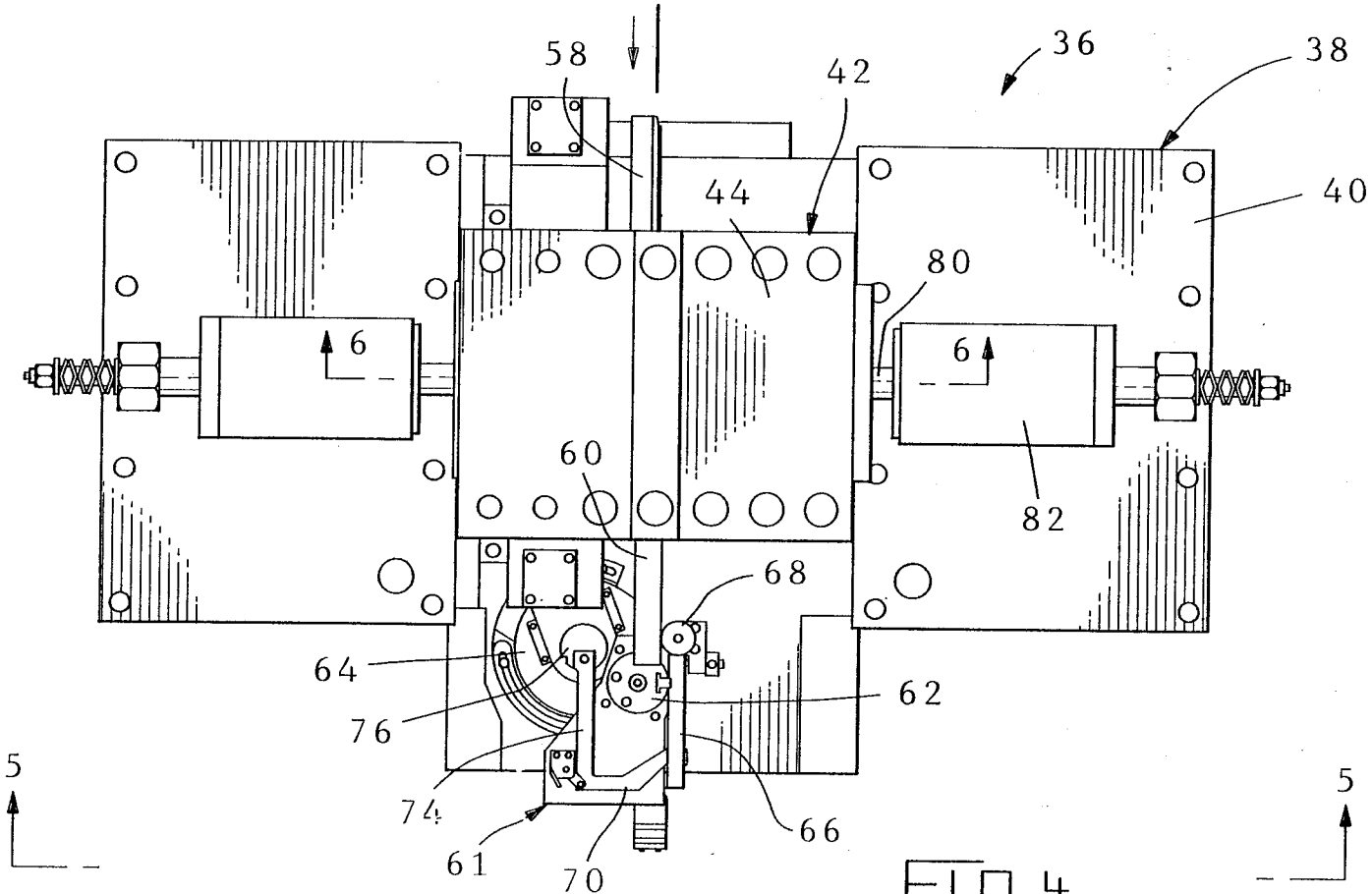

FIG. 4 is a top plan view of an individual module of a machine described in U.S. Pat. No. 4,497,196.

Figure 5:
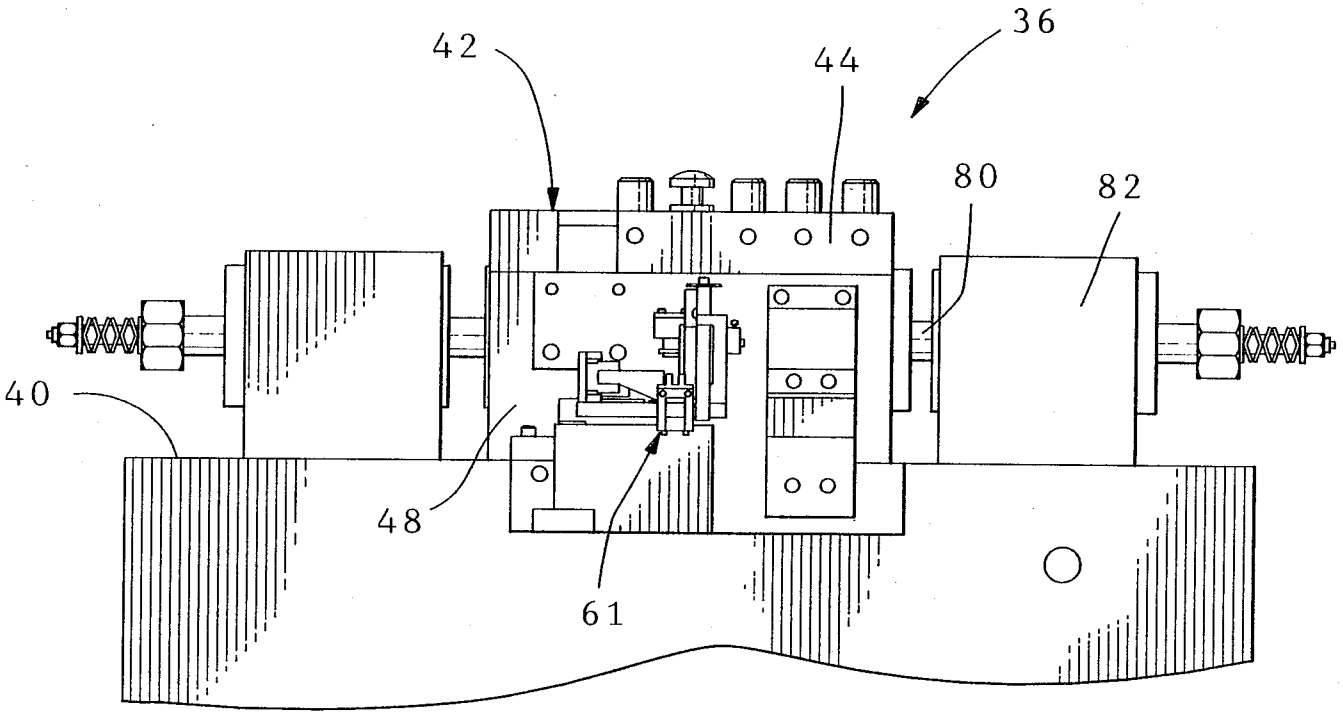
Figure 6:
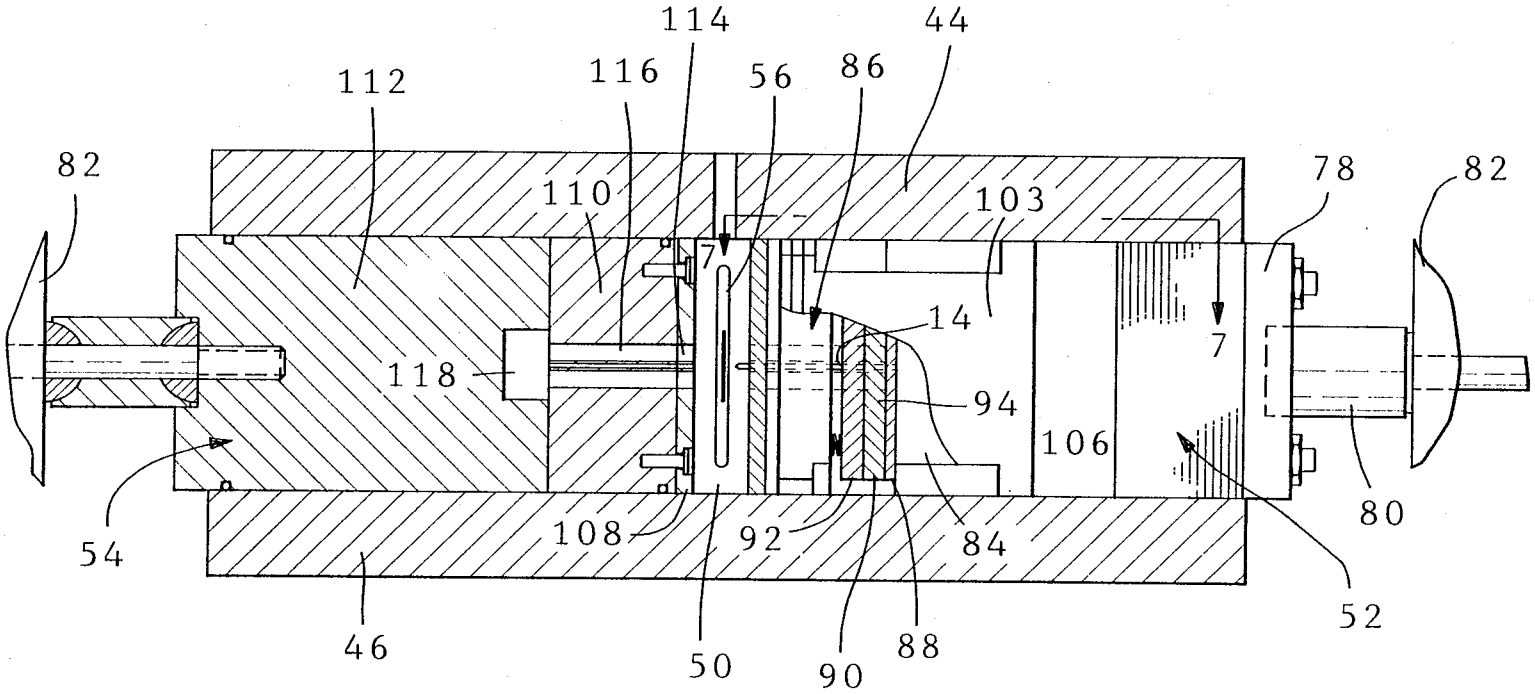

FIGS. 5 and 6 are views looking in the directions of the arrows 5—5 and 6—6 of FIG. 4.

Figure 7:
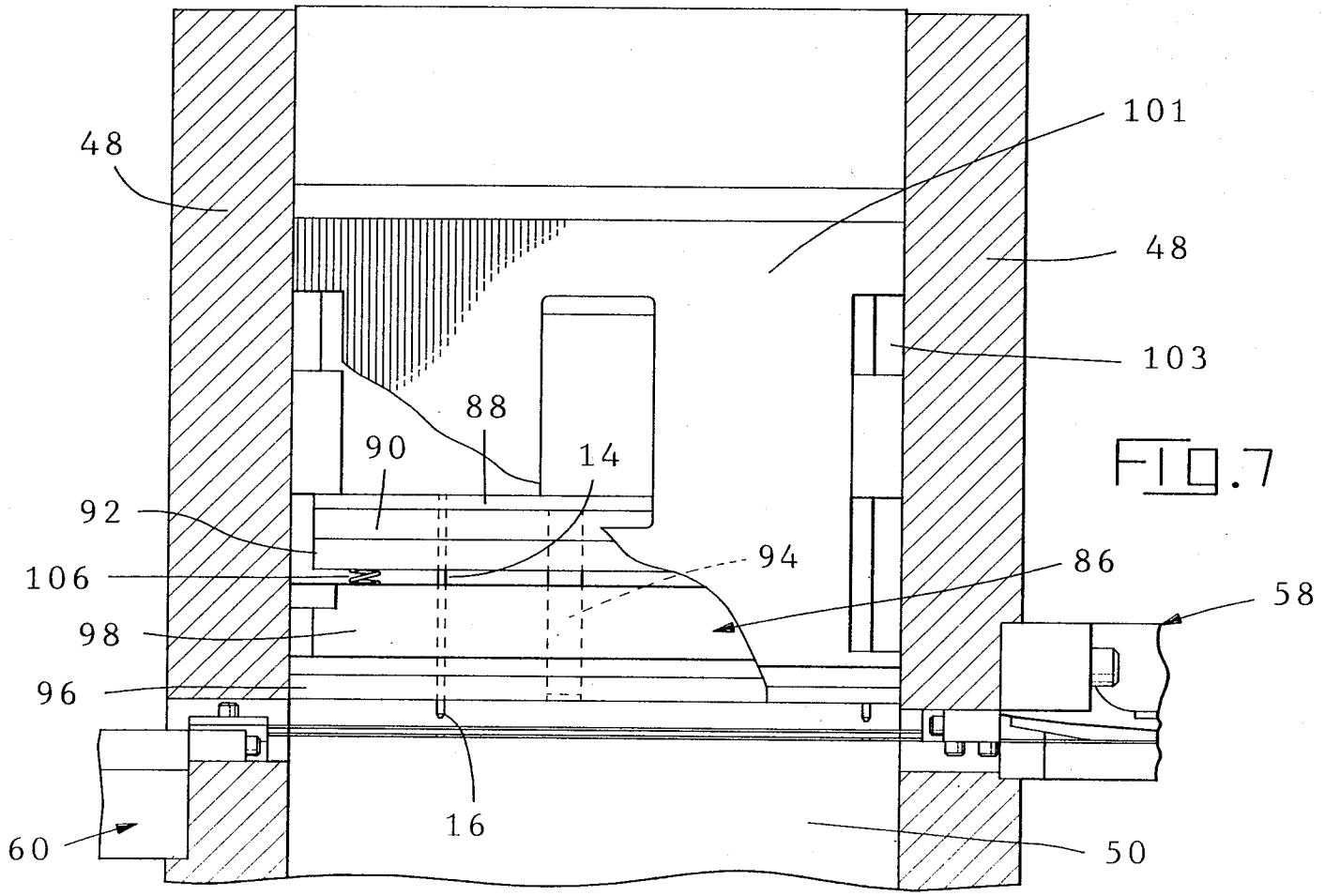

FIG. 7 is a fragmentary sectional view looking in the direction the arrows 7—7 of FIG. 6.

Figure 8:
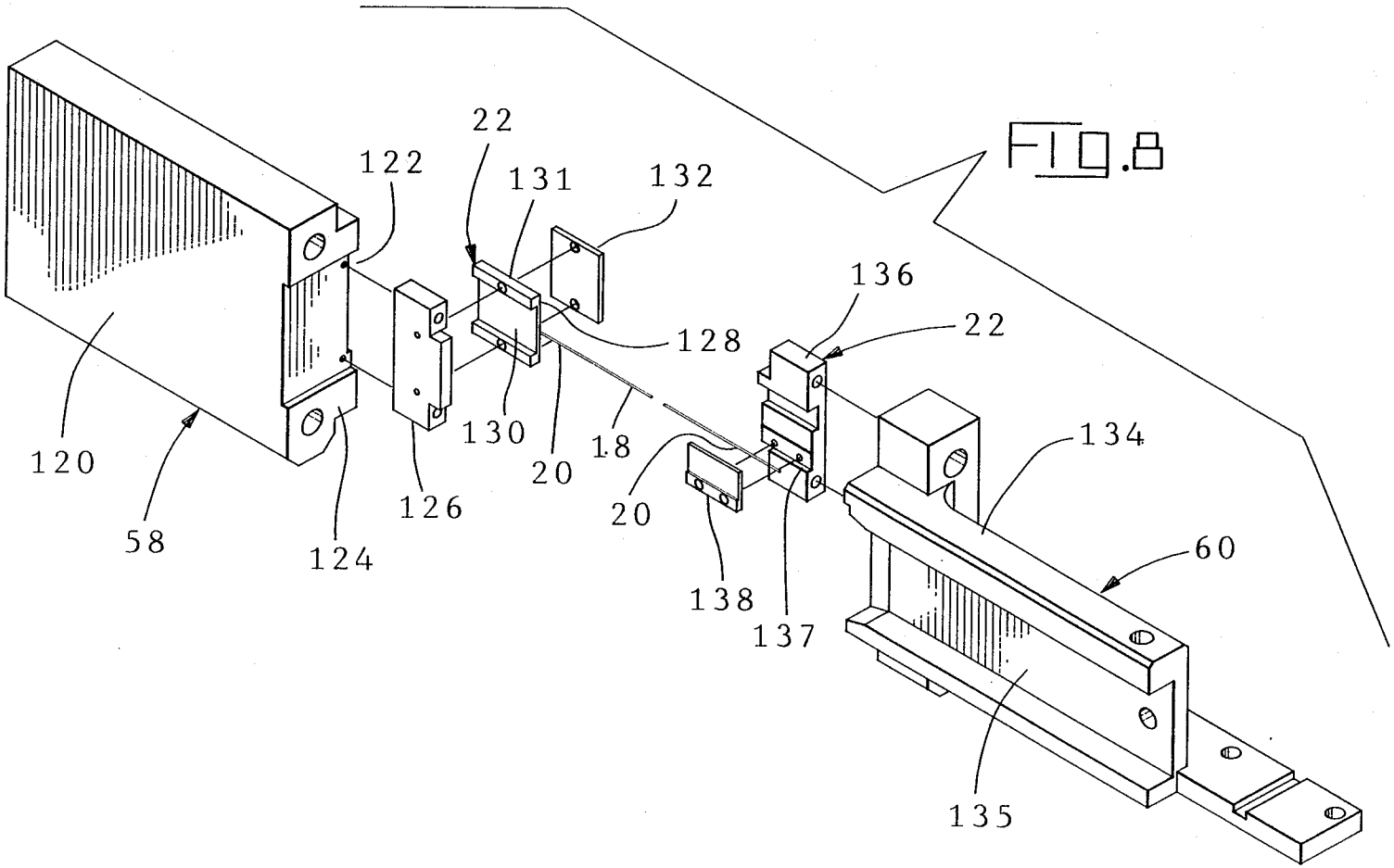

FIG. 8 is a perspective exploded view showing the parts of the inlet and outlet guides of the machine shown in FIG. 4 showing particularly the manner in which the strip retainer is secured to these guides.

Figure 9:
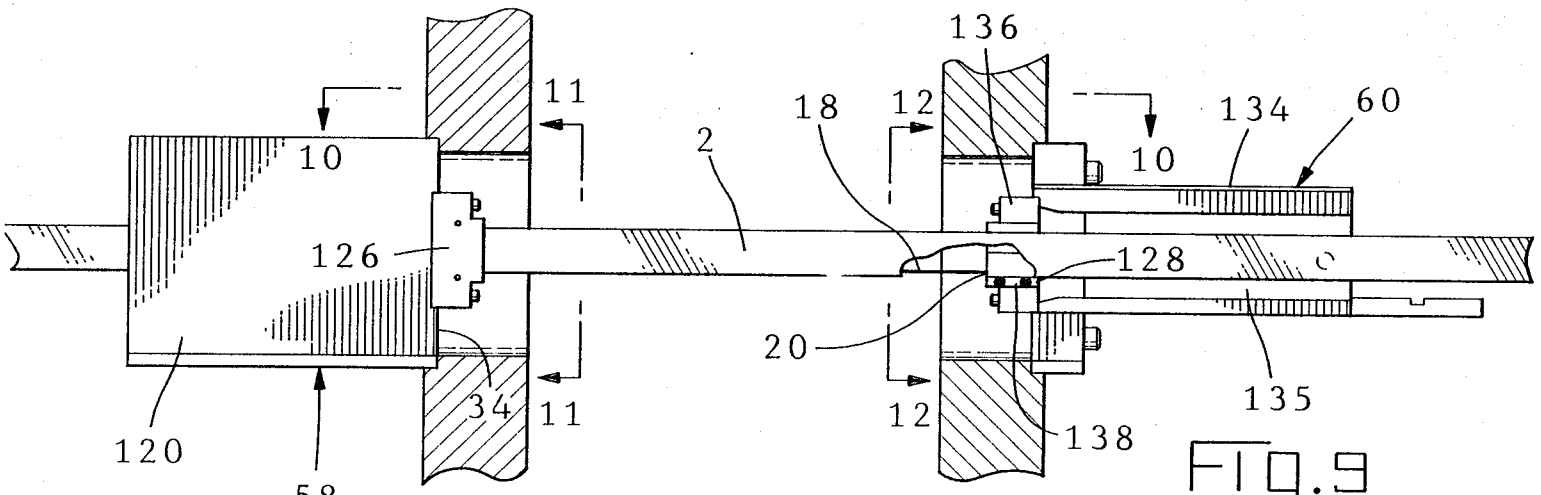

FIG. 9 is a side view of the parts shown in FIG. 8 with the parts assembled to each other and mounted on the sides of the tooling assembly housing of the machine.

Figure 10:
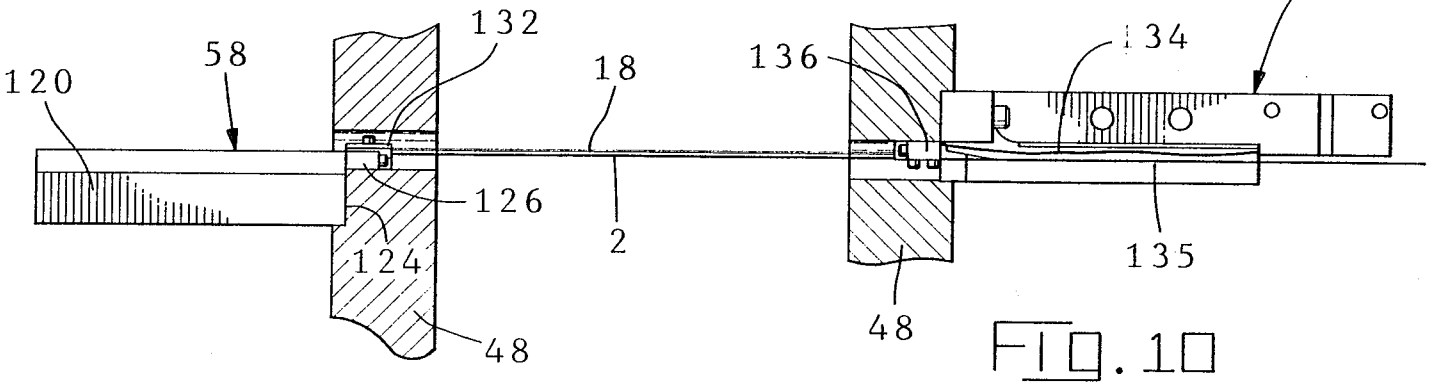
Figure 11:
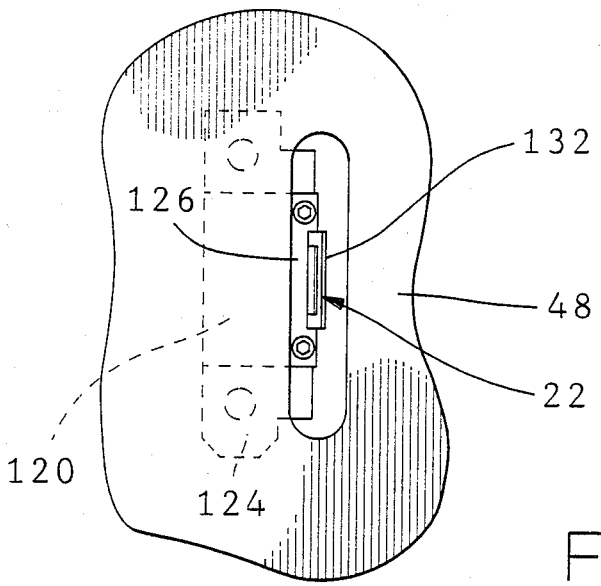
Figure 12:
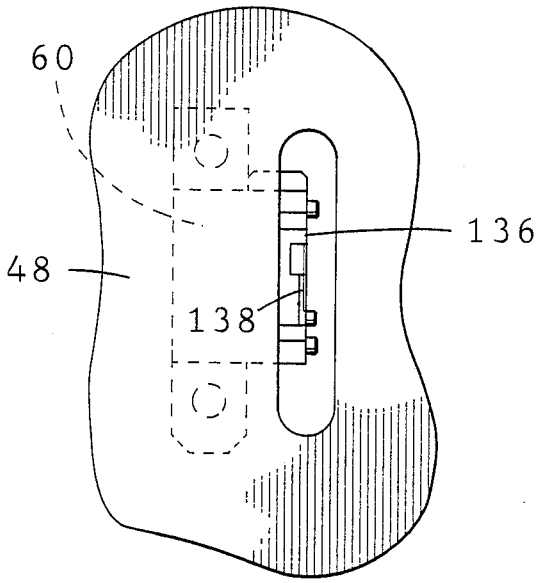

FIGS. 10, 11, and 12 are views looking in the direction of the arrows 10—10, 11—11, and 12—12 of FIG. 9.

Figure 13:
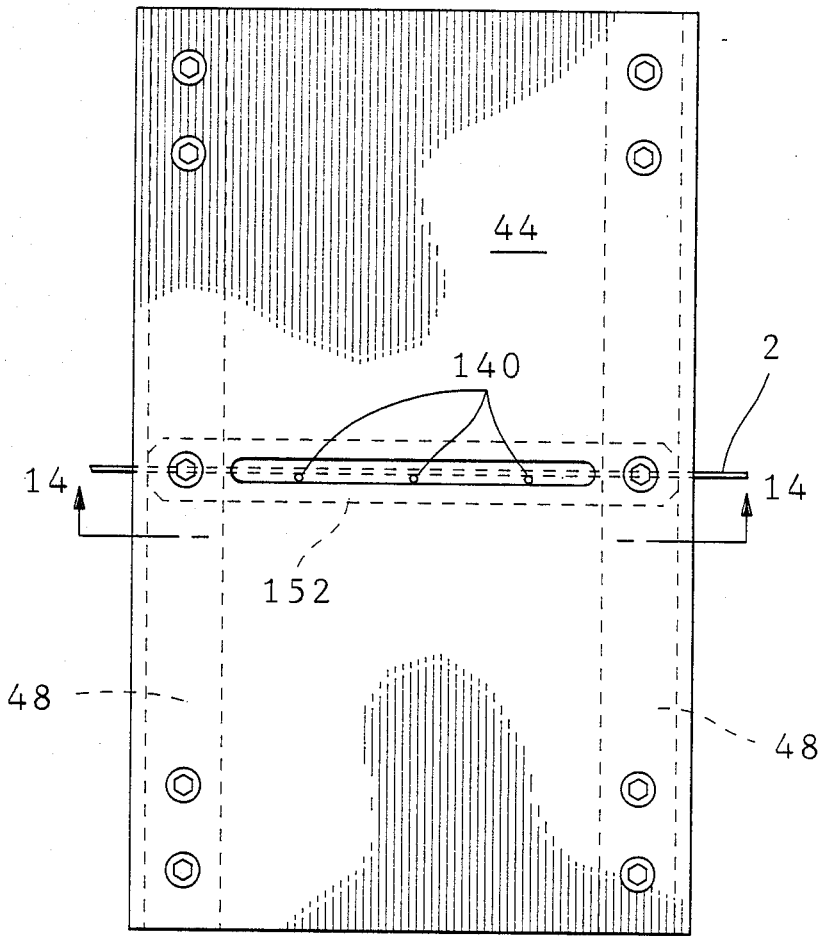

FIG. 13 is a top plan view of the tooling assembly housing of a machine of the type shown in FIG. 4 having a strip retainer in accordance with an alternative embodiment incorporated therein.

Figure 14:
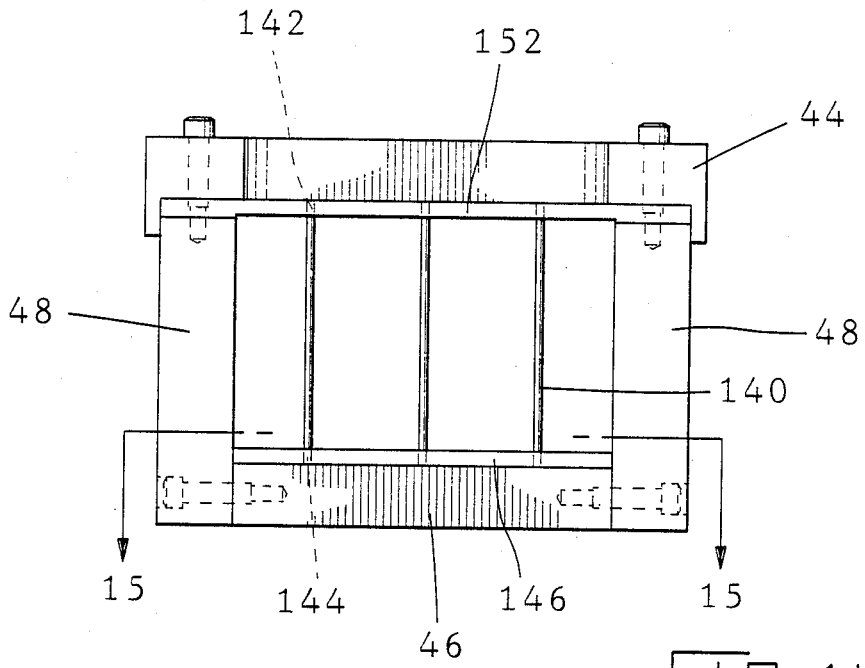

FIG. 14 is a view looking in the direction of the arrows 14—14 of FIG. 13.

Figure 15:
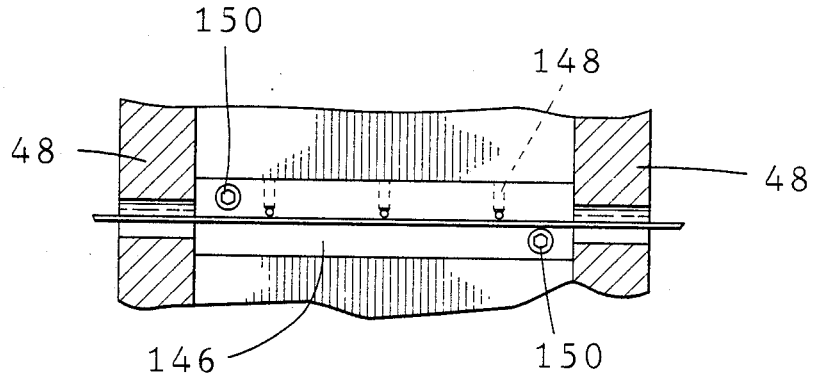

FIG. 15 is a view looking in the direction of the arrows 15—15 of FIG. 14.

Figure 16:
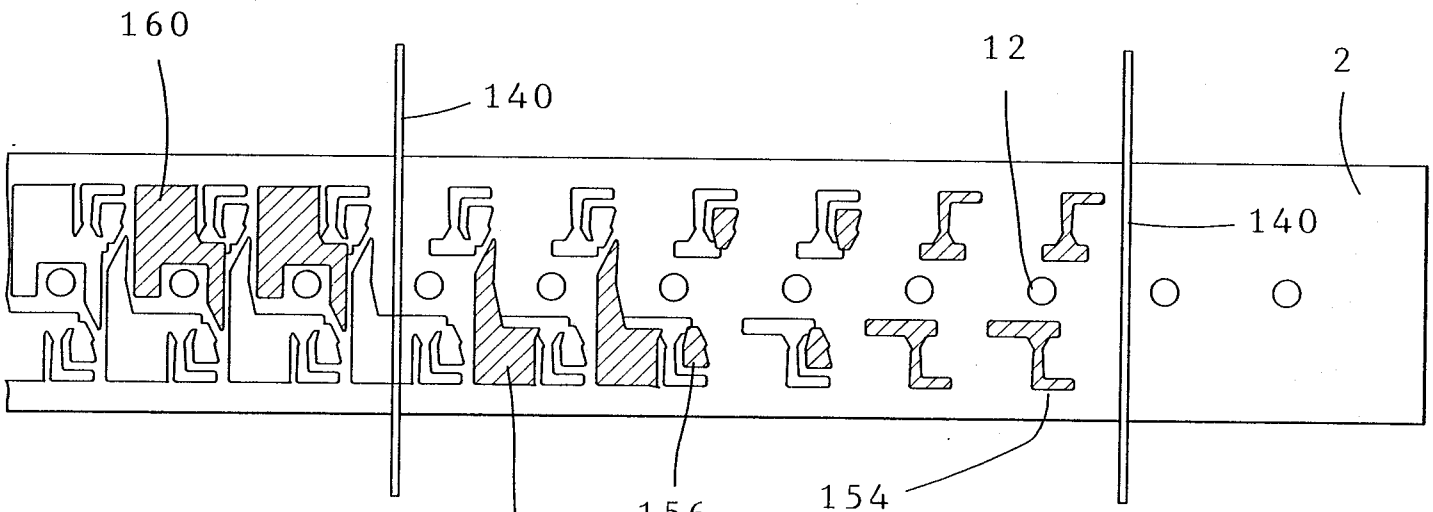

FIG. 16 shows a short portion of strip material which is in the operating zone of a machine module and illustrates the location of strip retainers relative to the punches and the pilot holes.

THE DISCLOSED EMBODIMENT

Figure 1:
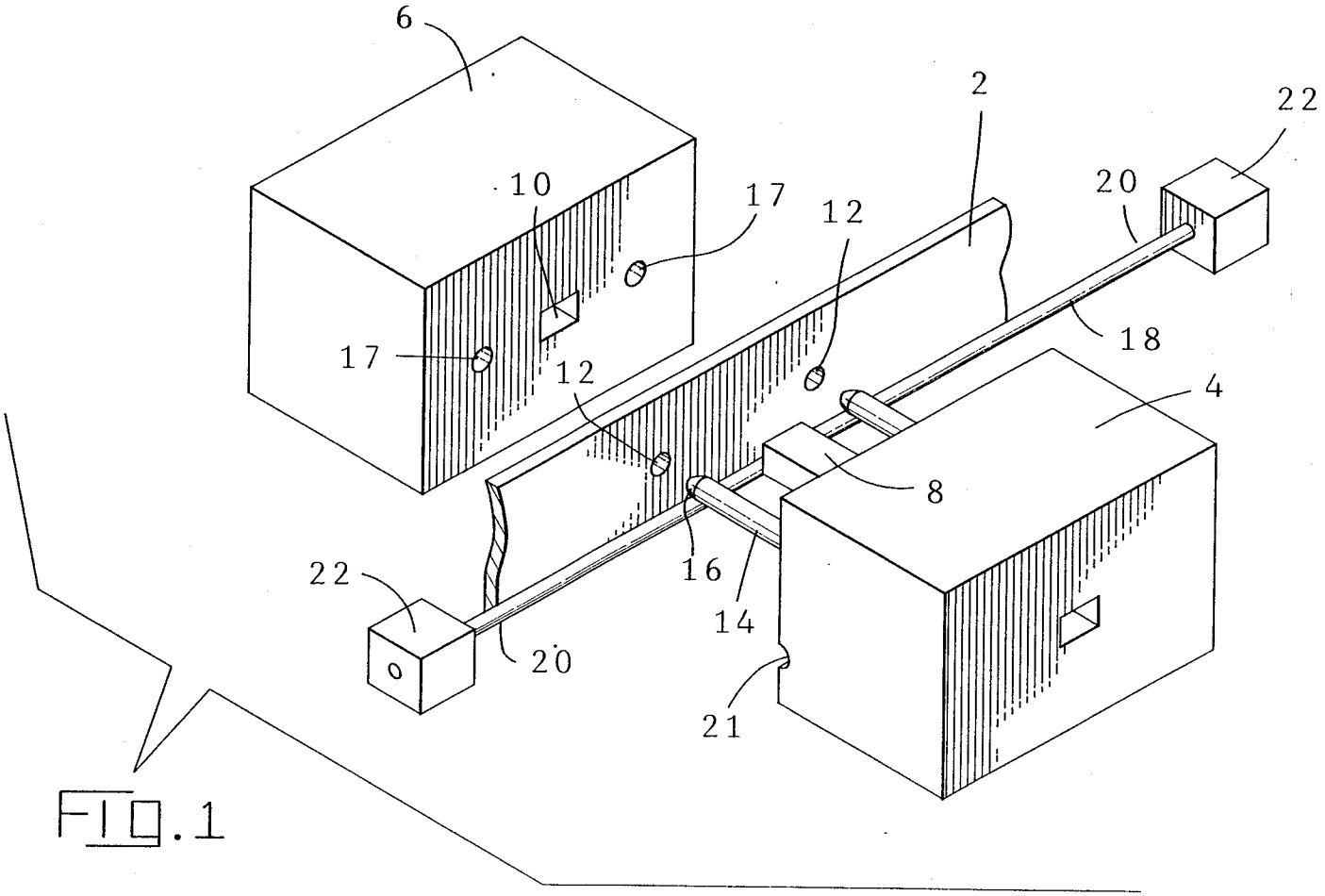
FIG. 1 is a perspective diagrammatic view showing a punch assembly, a die assembly, and a strip restraining or retaining means in accordance with the invention.
Figure 2:
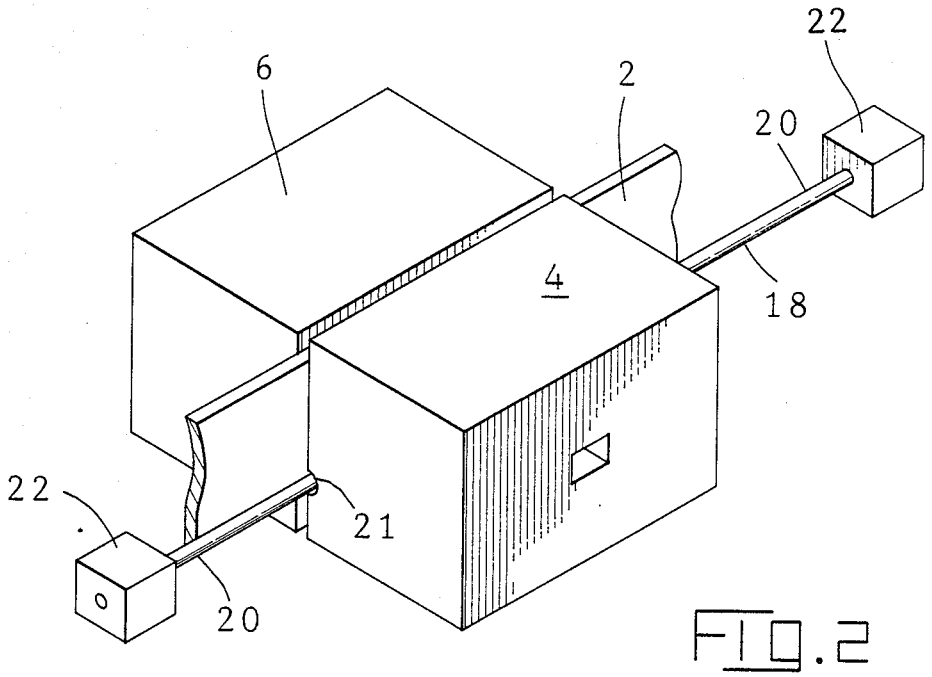
FIGS. 2 and 3 are views similar to FIG. 1 showing the positions of the parts at different stages of the punching operation.
Figure 3:
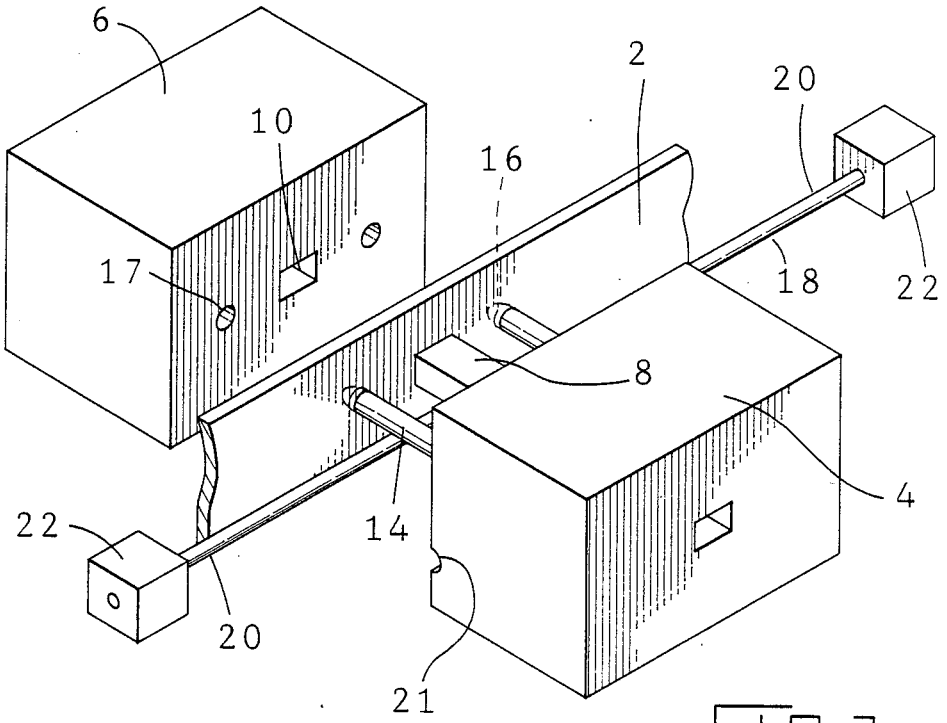

The essential features of the invention can be understood from an inspection of FIGS. 1-3 which show a strip of material 2 which is fed through an operating zone between a punch assembly 4 and a die assembly 6. The punch and die assemblies are movable towards and away from each other between the positions of FIGS. 1 and 2. The punch assembly 4 carries a single punch 8 and the die assembly 6 has a die opening 10 in its face which is dimensioned to receive the punch so that a square or rectangular hole will be formed in the material when the punch and die assemblies move to their closed positions. The punch assembly 4 also has fixed pilot pins 14 extending therefrom having outer free ends 16 which are located beyond the end of the punch 8. These pilot pins enter previously punched pilot holes 12 in the strip and precisely position the strip in the operating zone prior to the movement of the punch against the surface of the strip and formation of the hole in the strip.

In the absence of a restraining means or a stripping means for the strip 2, there would be a tendency for the strip material to move with the pilot pins 14 and the punch 8 rightwardly as viewed in FIG. 2 when the punch and die assemblies move to their open positions. A retaining or restraining means 18 is provided in the form of a fine wire which extends parallel to the strip feed path and parallel to the strip between the face of the punch assembly 4 and the surface of the strip 2. This wire necessarily intersects the path of reciprocation of the punch assembly 4 but it is in non-intersecting relationship with the paths of reciprocation of the pilot pins 14 and the punch 8. The ends 20 of the wire 18 are fixed or secured at fixed securing means 22 so that the intermediate portion of the wire restrains movement of the strip material when the parts move from the position of FIG. 2 to the position of FIG. 3 and thereby strip the material from the punch 8 and the pilot pins 14.

It will be noted that a shallow groove 21 must be provided for the wire retainer 18 when the parts are in their closed positions and that openings 17 are provided in the die assembly 6 for the end portions of the pilot pins 14. These openings may merely be blind holes of a depth sufficient to accept the end portions of the pins when the parts are in their closed positions.

FIGS. 8-12 show the manner of incorporating the invention into a stamping and forming machine module of the type described in U.S. Pat. No. 4,497,196. FIGS. 4-7 show details of the machine module. Only those portions of the module which must be described for an understanding of the present invention will be described below and the stock stripper is not shown in FIGS. 4-7.

The machine module 36 comprises a module housing 38 having an upper surface 40 on which a tooling assembly housing 42 is mounted. The tooling assembly housing has a cover plate 44, a bottom plate 46 which is on the surface 40, and side plates 48 as shown in FIG. 7. These housing plates define a passageway 50 having a rectangular cross-section in which are contained the first and second tooling assemblies 52, 54. The side plates have slots 56 through which the strip material is fed. Inlet and outlet guide assemblies 58, 60 are provided which guide the strip along its feed path. The strip is fed by an intermittent strip feeding mechanism 61 comprising a feed sprocket 62 which is indexed during each feeding interval by a motor 64. The strip is held against the teeth of the sprocket during feeding intervals by a movable guide 66 which is pivoted at 68 so that it can be moved away from the sprocket during non-feeding intervals. Such movement of the guide 66 is accomplished by a bell crank having one arm 70 which has a slidable connection with the guide 66 and which has a second arm 74 which is pivoted to an eccentric 76. This feeding mechanism is described in greater detail in application Ser. No. 07/057,556, filed June 3, 1987.

The first tooling assembly 52 has a backplate 78 thereon which is adjacent to the upper end 82 of an oscillating lever and is spaced from the lever end 82 by a spacer 80. The second tooling assembly 54 is similarly spaced from the upper end of an identical lever as shown. The manner in which these levers are oscillated is described fully in U.S. Pat. No. 4,497,196. The backplate 78, the lever 82 and spacer 80 are not shown in FIG. 7 in the interest of simplicity and in view of the fact that these features are shown in FIG. 6.

The first tooling assembly 52 (FIGS. 6 and 7) comprises a ram block 84 and a face plate assembly 86. The ram block has a spacer plate 88 on its left hand side as viewed in FIG. 6 and the tools in the form of punches 94 are held on the ram block by a tool holder plate 90, a retainer plate 92, and keys which pass through notches in the punches 94. The face plate assembly 86 comprises a face plate 96 and a backup plate 98 which is secured to the face plate by fasteners. The punches extend through aligned openings in the face plate and the backup plate and their leading or fee ends are recessed within the face plate when the first tooling assembly is in its open position. The face plate assembly 86 is movable between an extended position, in which it is spaced by a short distance from the retainer plate 92, to a retracted position in which it is against the retainer plate 92. The face plate assembly is normally biased to its extended position by springs 106 which are between the retainer plate 92 and the backup plate 98. The face plate assembly must move to its retracted position so that the outer or free ends of the punches will move relatively beyond the surface of the face plate and perform their punching function.

As described in application Ser. No. 07/074,656, filed July 17, 1987, top and bottom guide plates 101 and side guide or bearing plates 1 03 are interposed between the surface of the ram block and the internal surfaces of the passageway 50. These bearing and guide plates are secured to the face plate assembly and extend rightwardly as viewed in FIG. 6 over portions of the ram block. Their function is to guide the face plate and the ram block precisely during reciprocation of the tooling assembly.

The second tooling assembly 54 comprises a die plate 108, a die backup plate 110, and a ram block 112. The die plate 108 has die openings 114 therein in alignment with the punches and passageways 116 extend through the backup plate 10 to a recess 118 which extends transversely through the ram block 112. The scrap slugs which are produced in the punching operations are pushed through these passageways and into the transverse passageway 118. Disposal of the slugs can be accomplished by a belt disposal system, not shown, as described in application Ser. No. 07/089,191, filed Aug. 25, 1987.

FIGS. 8–12 illustrate the manner in which the wire 18 is secured such that its intermediate portion extends across the operating zone of the machine, that is, through the passageway 50. These views show only the inlet and outlet guide assemblies 58, 60 and the manner in which the ends 20 of the wire are secured in these guide assemblies. The tooling assemblies themselves and the tooling assembly housing are not shown in the interest of clarity.

The inlet guide assembly 58 comprises a guide plate 120 which is secured against the associated sidewall 48 as shown in FIG. 11. This guide plate 120 has a right hand side 122 as viewed in FIG. 8 across which the strip is fed and has an end 124 which is against the housing side plate 48. A locator plate 126 is also secured against the end 122 and a positioner plate 128 is secured to the rightwardly facing side surface of the locator 126. The positioner 128 has a channel 130 through which the strip 2 is fed and has a rightwardly facing side surface 131 (FIG. 8) against which the end portion 20 of the wire is clamped by means of a clamping plate 132. The parts are secured to each other by suitable fasteners as indicated by the screw holes shown in FIG. 8. Advantageously a V-notch is provided in the side surface 132 for the end 20 of the wire. The intermediate portion of the wire thus extends parallel to, and immediately beside, the portion of the strip 2 which is located in the passageway 50 of the tooling assembly housing 42. The securing means indicated at 22 in FIG. 1 thus comprises the plates 128, 130.

The outlet strip guide assembly 60 comprises a guide plate 134 having a channel 135 for the strip. The end surface of plate 134, which is substantially against the side plate 48 at the outlet of the tooling assembly housing, has a locator 136 secured thereto on which there is provided a ledge 137. A V-notch is provided on the surface of the locator 136 and the end 20 of the wire is clamped in this V-notch by a clamping plate 138. The plate 138 also has a ledge over which the strip moves as indicated in FIG. 9.

A recess (not specifically shown) must e provided in the face plate 96 for the wire 18 when the two assemblies are in their closed positions and the face plate is substantially against the strip material. The wire itself will have a diameter of no more than about 0.014 inches and the recess in the face plate is therefore relatively shallow.

The intermediate portion of the wire 18 obviously has to intersect the path of reciprocation of the tooling assembly 52 in which the punches and pilot pins are carried, but it must not intersect the path of reciprocation of the punches or the pilot pins themselves. Ordinarily a single wire will serve the purpose of stripping the material from the pilot pins and the punches but if required, a second wire can be provided and secured in the manner shown in FIG. 8.

FIGS. 13–16 illustrate the manner in which stripping and retaining wires 140 can be mounted in the operating zone of the machine with the axes of the wires extending transversely of the direction of strip feed through the operating zone. The wires 140 have upper ends 142 and lower ends 144. The lower ends are clamped by means of a clamping plate 146 which is secured against the surface of the lower or bottom housing plate 46 by means of fasteners 150. The ends of the wires are secured to the plate 146 by set screws 148 as shown in FIG. 15. The upper ends 142 of the wires are similarly secured in a clamping plate 152 which is clamped between the top plate 44 and the side plates 48 of the tooling assembly housing.

FIG. 16 shows the operations which may be carried out in a typical module on the strip material 2. In these views, four sets of punches are indicated at 154, 156, 158, and 160. Each set of punches comprises four individual punches so that the die station is referred to as a "four out station" for the reason that four blanks are produced during each operating cycle. The die station is also referred to as a "two out two feed" die station; two rows of blanks are produced and the feeding stroke feeds two blanks in each row. Two stripping and retaining wires 140 are provided in FIG. 16, the right hand wire being located between a pilot hole and the first set of punches 154. The left hand wire 140 is located between the set of punches 158 and the set of punches 160. Note that the left hand wire 140 crosses openings in the strip which were produced by the punches 158.

Under some circumstances, it will be necessary to mount the stripping wires as shown in FIG. 16 rather than as shown in FIG. 1 for the reason that it would be impossible to locate a horizontally extending wire (parallel to the direction of strip feed and parallel to the strip) without intersecting one or more of the sets of punches shown in FIG. 16. Under many circumstances, however, the strip may have a continuous carrier strip which is not engaged by any of the punches and the stripper wire can extend along this carrier strip.

The invention can be employed to remove the strip 2 from pilot pins in all stamping and forming machines which have the pilot pins fixed to the first tooling assembly 86 or its equivalent. The stripping means of the invention is not required for stripping the material from the punches of the machine module shown in FIGS. 4–7 for the reason that the face plate assembly 86 performs the stripping function. However, the invention can be used to remove the material from the punches, or the forming tools, in stamping and forming machines which do not have a movable face plate assembly and most conventional stamping and forming machines are not provided with a movable face plate assembly such as the assembly 86.

It will be apparent from the foregoing description that an extremely effective stock stripper or retainer has been disclosed which is extremely simple in that it has no moving parts and which occupies no space in the tooling area of a stamping and forming machine. The principles of the invention can be applied to a variety of types of stamping and forming machines and is particularly adapted for machines having horizontally mounted tooling assemblies as described above which are themselves quite compact in many instances and which do not permit the inclusion of previously known types of stock stripping and retaining devices.

We claim:

1. A machine for punching holes in strip material, the machine comprising strip feeding means for feeding strip material along a strip feed path which extends through an operating zone, a punch assembly and a die assembly in the operating zone on opposite sides of the strip feed path, the punch and die assemblies being in opposed confronting relationship and being movable relatively towards and away from each other along a punch and die assembly path of reciprocation between an open position, in which the punch and die assemblies are remote from each other, and a closed position, in which the punch and die assemblies are proximate to each other, the punch assembly having punch means thereon and the die assembly having die opening means which is dimensioned to receive the punch means, the punch means being movable relatively towards, and into, the die opening means along a punch means path of reciprocation when the punch and die assemblies move from their open positions to their closed positions thereby to punch at least one hole in the strip material, the punch assembly having pilot pin means ex tending therefrom and the strip material having pilot hold means which are dimensioned to receive the pilot pin means thereby precisely to position the strip material in the operating zone prior to the arrival of the punch assembly and the die assembly at their closed positions, the pilot pins means being reciprocable along a pilot pin path of reciprocation, the machine being characterized in that:

a strip retainer is provided for stripping the strip material from the pilot pin means when the punch assembly and the die assembly move from their closed positions to their open positions, the strip retainer comprising at least one static member which is beside, and adjacent to, the strip feed path, the static member being between the punch assembly and the strip feed path and intersecting the punch and die assembly path of reciprocation, the strip retainer being in non-intersecting relationship with the punch means path of reciprocation and with the pilot pin path of reciprocation, the strip retainer comprising a wire which extends laterally beyond the punch and die path of reciprocation on two opposite sides thereof and having retainer ends which are secured to fixed securing means, whereby during each operating cycle, the pilot pin means moves into the pilot hole means in the strip material, and during subsequent movement of the punch assembly to its open position, the strip retainer restrains the strip material from being carried with the pilot pin means laterally of the strip feed path and thereby strips the strip material from the pilot pin means.

2. A machine as set forth in claim 1 characterized in that the strip retainer extends parallel to the strip feed path.

3. A machine as set forth in claim 1 characterized in that the strip retainer extends transversely of the strip feed path.

4. A machine as set forth in claim 1 characterized in that the punch assembly and the die assembly both move when the punch assembly and the die assembly move between their open and closed positions.

5. A machine as set forth in any of claims 1, 3, or 4 characterized in that upstream and downstream strip guides are provided on the strip feed path on opposite sides of the operating zone, the upstream and downstream strip guides being respectively upstream and downstream, relative to direction of strip feed, from the operating zone, the fixed securing means being proximate to the upstream and downstream strip guides.

6. A machine as set forth in claim 5 characterized in that the fixed securing is on the upstream and downstream strip guides.

7. A machine as set forth in claim 4 characterized in that the punch and die assemblies are in horizontal opposed confronting relationship.

8. A machine as set forth in claim 3 characterized in that a plurality of strip retainers are provided at spaced intervals along the strip feed path in the operating zone.

* * * * *